US007510434B2

(12) United States Patent
Häntsch et al.

(10) Patent No.: US 7,510,434 B2
(45) Date of Patent: Mar. 31, 2009

(54) COAXIAL HF PLUG-IN CONNECTOR

(75) Inventors: Ralf Häntsch, Raubling (DE); Joachim Herold, Flintsbach (DE); Manfred Stolle, Bad Aibling (DE); Stephan Wenig, Eggstätt (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 11/795,315

(22) PCT Filed: Dec. 8, 2005

(86) PCT No.: PCT/EP2005/013176

§ 371 (c)(1),
(2), (4) Date: Jul. 16, 2007

(87) PCT Pub. No.: WO2006/087024

PCT Pub. Date: Aug. 24, 2006

(65) Prior Publication Data

US 2008/0139044 A1 Jun. 12, 2008

(30) Foreign Application Priority Data

Feb. 18, 2005 (DE) ..... 10 2005 007 589

(51) Int. Cl.
*H01R 9/05* (2006.01)

(52) U.S. Cl. ..... 439/578

(58) Field of Classification Search ..... 439/578–580
See application file for complete search history.

(56) References Cited

U.S. PATENT DOCUMENTS 4,575,694 A * 3/1986 Lapke et al. ..... 333/22 R
6,101,080 A * 8/2000 Kuhne ..... 361/119

FOREIGN PATENT DOCUMENTS

| | | |
|---|---|---|
| DE | 295 11 450 | 9/1995 |
| DE | 102 08 402 | 9/2003 |
| EP | 0 129 820 | 1/1985 |
| WO | 99/43052 | 8/1999 |
| WO | 2004/004064 | 1/2004 |

OTHER PUBLICATIONS

International Search Report for PCT/EP2005/013176, mailing date Mar. 2, 2006.

* cited by examiner

*Primary Examiner*—Javaid Nasri
(74) *Attorney, Agent, or Firm*—Nixon & Vanderhye P.C.

(57) ABSTRACT

A coaxial HF plug-in connector comprises an axial bore embodied in an external conductor material on a connection side, in which an electric component is arranged. The aim is to improve the connector. For this purpose, the component in the axial bore is embodied in the form of an output branch which comprises a lower NF conductor, an internal dielectric, a balun and an external dielectric. The lower NF conductor is electrically connected to the balun base on the end of the in-plug connector connection side and to the internal conductor of the plug-in connector on the open end of the balun.

22 Claims, 7 Drawing Sheets

COAXIAL HF PLUG-IN CONNECTOR

CROSS-REFERENCES TO RELATED APPLICATIONS

This application is the U.S. national phase of International Application No. PCT/EP2005/013176 filed 8 Dec. 2005, which designated the U.S. and claims priority to DE 10 2005 007 589.4, filed 18 Feb. 2005, the entire contents of each of which are hereby incorporated by reference.

FIELD

The technology herein relates to a coaxial HF plug-in connector.

BACKGROUND AND SUMMARY

Coaxial HF plug-in connectors are used widely in electrical engineering. A common application is in this regard the use of coaxial plug-in connectors of this type as an interface to housings for the connection of coaxial lines to which high-frequency useful signals (HF signals) are transmitted.

However, in many uses, not only high-frequency useful signals but also low-frequency control signals and/or a DC voltage, for example for supplying power to the devices connected thereby, are transmitted via the same coaxial lines. One of these applications is, for example, the powering of head points, satellite reception equipment, etc.

It is therefore known to provide in the transmission path corresponding branch means via which the high-frequency useful signals (HF signals) can be separated from a DC voltage component or a low-frequency control signal (LF signal). This is frequently carried out by the interposition of capacitors or capacitor means via which the high-frequency useful signals can be transmitted, whereas the DC voltage component and/or the low-frequency control signals are decoupled.

However, a means of this type requires additional modules which are generally accommodated so as also to be integrated in a separate housing or in a separate chamber in a housing of a subsequent device used to process signals.

A generic coaxial connector has become known, for example, from U.S. Pat. No. 4,575,694. In an HF plug-in connector known therefrom, a hole is provided in the external conductor material so as to provide a switchable terminating impedance at this location. EP 0 129 820 A2 can also be taken to disclose as known a coupling element for connecting a signal transmission means to a coaxial main line. This element is a capacitive coupling element for connecting a signal transmission means to a coaxial main line. There is provided in this case a coaxial tap using a coaxial segment of the external conductor.

Finally, DE 102 08 402 A1 discloses in principle that electrical components can also be arranged in a dielectric.

The exemplary illustrative non-limiting implementation provides an improved coaxial HF plug-in connector allowing compact decoupling of low-frequency control signals and/or DC voltage components from a high-frequency useful signal.

In an exemplary illustrative non-limiting implementation, the corresponding separating means for the separation of high-frequency useful signals from low-frequency control signals and/or a remote supply voltage (DC voltage component) is accommodated in the coaxial plug-in connector itself.

The coaxial plug-in connector has in this case on the connection side, like conventional coaxial plug-in connectors, an external conductor and also an internal conductor held apart by a dielectric. However, in addition, the contact plug-in connector in an exemplary illustrative non-limiting implementation comprises a branch circuit having an HF internal conductor on which the high-frequency signals are further transmitted and an LF internal conductor on which the low-frequency control signals and/or the DC voltage component for the remote supply voltage which may be required are decoupled. In the exemplary illustrative non-limiting implementation this may be carried out by a $\lambda/4$ balun.

In an exemplary illustrative non-limiting implementation, this balun is accommodated in a corresponding hole in the plug-in connector external conductor, thus further improving the HF signal attenuation.

It has proven beneficial to configure the branch circuit in such a way that the HF internal conductor and the LF internal conductor extend parallel to each other. However, an at least slightly diverging orientation is also possible, the angle preferably being less than ±10°, in particular less than ±5°, between the two branch lines.

In an exemplary illustrative non-limiting implementation, the HF signal conductor may be forwarded in the axial extension of the plug-in connector internal conductor and the LF internal conductor arranged in the coaxial connector on the output side, as a branch line offset radially relative to the HF signal conductor. An inverse configuration is also possible. In an exemplary illustrative non-limiting implementation, the branch circuit may be configured in such a way that the two line branches, extending parallel to each other, for the HF and the LF signals both to be positioned so as to be offset radially relative to the connector-side coaxial internal conductor.

The exemplary illustrative non-limiting arrangement may be configured in such a way that the pre-assembled plug-in connector internal conductor having the attached dielectric and the branch arrangement consisting of the HF internal conductor and the LF internal conductor having the associated balun can be introduced from the connector side into the external conductor and assembled. However, the exemplary illustrative non-limiting arrangement may also be configured and designed in such a way that a corresponding assembly is possible from the opposing side or that the plug-in connector components are assembled on both sides.

Depending on the specific application, it is also possible, in an exemplary non-limiting arrangement, to use in the plug-in connector a plurality of baluns of differing lengths. This allows adaptation to the respective HF frequency range to be transmitted and the desired locking effect and attenuation to be carried out.

In an exemplary illustrative non-limiting implementation, the omission of a specific housing or a specific chamber in a housing and the accommodation of the branch means, including the associated attenuation means, in the plug-in connector allows a considerable amount of space to be saved. It is particularly surprising in this regard that this ultimately does not lead or does not have to lead to enlargement or relevant enlargement of the plug-in connector. In addition, the exemplary illustrative non-limiting plug-in connector can be manufactured extremely economically as, in contrast to conventional plug-in connectors, an additional hole is required merely in the external conductor.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
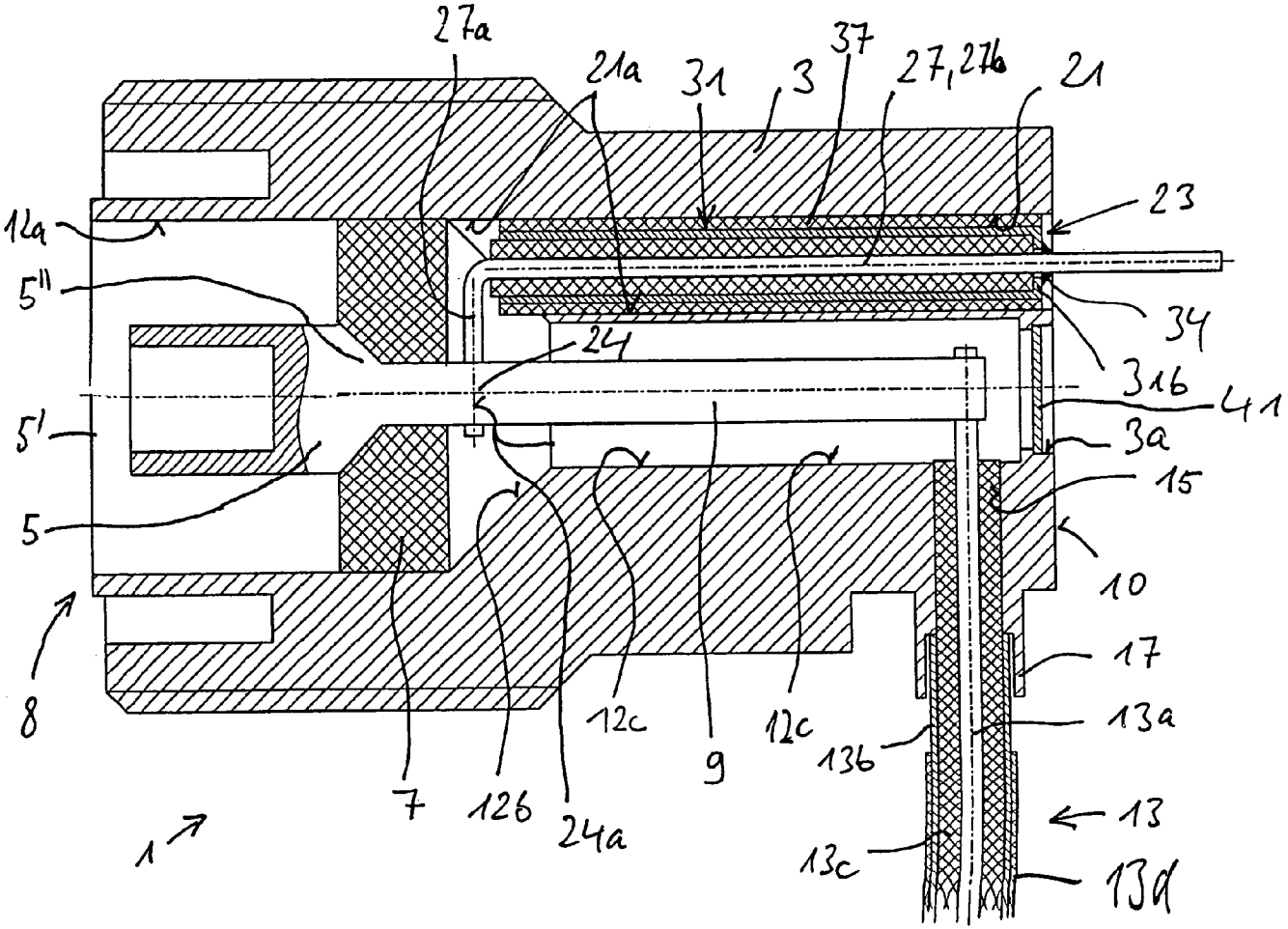
FIG. 1 is a schematic axial sectional view through an exemplary illustrative non-limiting coaxial connector.

Reference will be made hereinafter to FIG. 1 which shows an exemplary illustrative non-limiting implementation in axial cross section.

FIG. 1 shows in axial section a coaxial plug-in connector 1 comprising a plug-in connector external conductor 3 and, on the connector connection side (i.e. located on the left-hand side in FIG. 1), coaxially thereto in a known manner a plug-in connector internal conductor 5 which is held via an insulator, in the illustrated implementation, a disc-shaped dielectric 7, in the external conductor 3 so as to prevent electrogalvanic contact between the internal and external conductors.

In the illustrative non-limiting implementation, the plug-in connector internal conductor has, on the connector connection side, a sleeve-type extension 5'. However, a pin-like internal conductor connection can also be provided at this location.

The coaxial plug-in connector thus formed is preferably standardized on its coaxial connection side 8, for example configured as a 7/16 connector to EN 122 190.

In the illustrative non-limiting implementation, the standardized region on the connection side 8 in the axial extension of the plug-in connector internal conductor 5 then merges with an HF internal conductor 9 via a tapering intermediate portion 5".

As may be seen from the illustrative implementation, the central opening or hole 12*a*, which is located on the connector side and in which the sleeve-type extension 5' of the coaxial plug-in connector is also arranged, merges via an intermediate hole 12*b* which tapers conically or in the shape of a truncated cone with an outlet-side axial hole 12*c* in which the HF internal conductor 9 is positioned so as to be set apart from the walls of the plug-in connector external conductor 3.

The transitions from the plug-in connector internal conductor 5 to the HF internal conductor 9 and also from the hole 12*a* to the hole 12*c* do not have to extend continuously as in the non-limiting implementation. Abrupt changes in diameter between the portions are also possible.

In the illustrated implementation, the HF internal conductor 9 ends before the end-face external conductor end 10 where, extending in the radial direction, a coaxial connection cable 13 forwarding the HF signals (high-frequency signals) is connected in the plug-in connector external conductor 3 via a radial hole 15. For this purpose, the coaxial connection cable 13 is stripped in a correspondingly stepped manner at its connection end; the associated internal conductor 13*a* is guided through the HF internal conductor 9, through a preferably groove-like aperture therein, and is soldered to said HF internal conductor 9. The dielectric 13*c* surrounding the internal conductor 13*a* insulates the internal conductor from the plug-in connector external conductor and is introduced for this purpose into the radial hole 15. The end face and/or the circumferential portion of the stepped external conductor 13*b* is electrogalvanically contacted at the end face of the sleeve-type connection portion 17 which is part of the plug-in connector external conductor 3. Reference numeral 13*d* denotes the outer insulation of the coaxial connection cable 13.

Via the plug-in connector internal conductor 5, and thus via the HF internal conductor 9 pertaining to the plug-in connector internal conductor 5, high-frequency signals (HF signals) are therefore forwarded on the output side from the coaxial connection side 8 to the connected coaxial cable 13.

If there is then connected to the coaxial connector of this type, on the connection side, a coaxial cable via which not only HF signals (i.e. high-frequency useful signals) but also LF signals (for example, low-frequency control signals and/or a remote supply voltage or DC voltage) are transmitted, these are to be decoupled via a decoupling branch by means of the exemplary illustrative non-limiting coaxial plug-in connector. This therefore means that the uncoupling in the decoupling branch should be as large as possible for the frequency range of the HF signal.

In the illustrated implementation, there is then formed in the material of the plug-in connector external conductor 3, parallel to the outlet-side axial hole 12*c* (having a smaller diameter than the inlet-side axial hole 12*a*), a further hole 21 in which there is accommodated the aforementioned decoupling branch 23 consisting of the LF internal conductor 27, internal dielectric 35, balun 31 and external dielectric 37. The LF internal conductor is broken down in this case into a radial portion 27*a* and an, in the illustrated implementation, axial portion 27*b* extending parallel to the HF internal conductor 9.

As emerges from the schematic illustration according to FIG. 1 but also from the perspective view to be discussed hereinafter according to FIGS. 3*a* and 3*b*, there is provided in the HF internal conductor 9—although, if required, also in the transition part 5" or still further toward the connection end of the plug-in connector internal conductor 5—a radial hole 24*a* (FIGS. 3*a* and 3*b*) in which the radial portion 27*a* of the LF internal conductor 27 is inserted, electrically contacted and optionally also soldered on.

Figure 2:
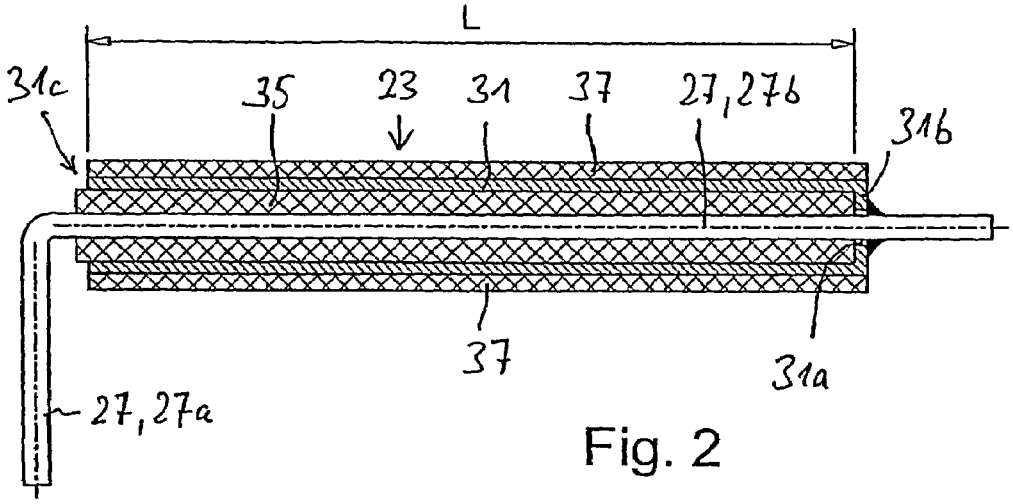
FIG. 2 is an enlarged detailed view of the balun for the LF signal decoupling branch.

A balun 31 is provided on the axial portion 27*b* of the LF internal conductor 27. The LF internal conductor 27 of the decoupling branch 23 is soldered to the base 31*b* of the balun 31 at the soldering point 34. The corresponding conditions are reproduced in the enlarged detailed view in FIG. 2.

If the length of the internal hole in the balun is $$L = \frac{1}{\sqrt{\varepsilon r}} x \frac{\lambda}{4},$$

wherein $\in_r$ is the corresponding dielectric constant of the internal dielectric 35 used and λ is the central wavelength of the frequency range to be transmitted in the HF branch, preferably the central wavelength of this frequency range, the short circuit thus formed inside the balun filled with plastics material or generally with a dielectric 35 is transformed at the open end of the balun into an idle state (λ/4 electrical length). This idle state on the open side 31*c* of the balun 31 is provided very close to the branch-off point 24 of the decoupling branch 23 and thus causes the HF signal to flow not into the decoupling branch 23 but rather into the HF branch and thus via the HF internal conductor 9.

In principle, however, instead of a dielectric 35 (internal dielectric 35) and the dielectric 37 (external dielectric 37) which is often made of plastics material, use may also be made of a dielectric made from a different material, even of air or the like.

However, in order further to improve the attenuation for the HF signal in the LF decoupling branch 23, there is also formed a very slight gap between the outer lateral surface of the balun and the adjoining wall 21*a*, surrounding the balun, of the hole 21. This interval between the outer or circumferential surface of the balun 31 and the adjoining inner wall 21*a* of the hole 21, in which the balun is located, is filled in the illustrated implementation using an insulator or dielectric 37 in order reliably to prevent electrogalvanic connection.

This slight gap between the outside of the balun and the housing (i.e. the external conductor of the decoupling branch) causes the uncoupling to be further increased. The gap is limited merely by the required dielectric strength (high-voltage strength between the external and internal conductors).

In the illustrated non-limiting implementation, the LF internal conductor thus protrudes axially, in the axial extension, from the connection end 10 of the plug-in connector housing thus formed.

Figure 3A:
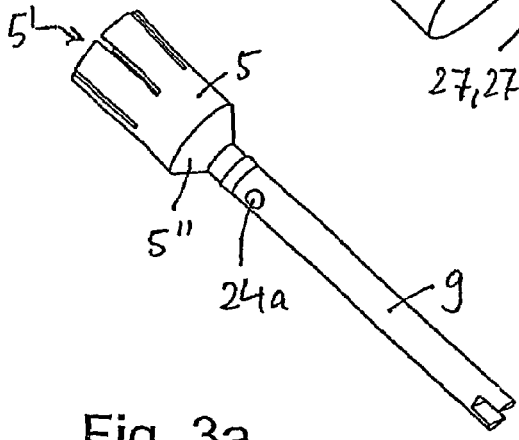
FIG. 3*a* is a schematic perspective view of the plug-in connector internal conductor which merges with the HF internal conductor.

In terms of manufacture, the plug-in connector internal conductor 5, which is integrally connected to the HF internal conductor 9, can be attached to a disc-shaped dielectric 7 as shown in FIG. 3*a*. The radial LF internal conductor portion 27*a* of the preassembled decoupling unit 23 is then inserted into the radial hole 24*a* in the HF internal conductor 9 (immediately adjacent to the dielectric 7), where it is soldered in accordance with the teaching that the axial distances between the HF internal conductor portion 9 and LF internal conductor portion 27*b* and also between the external conductor 3 and hole 21 correspond.

Figure 3B:
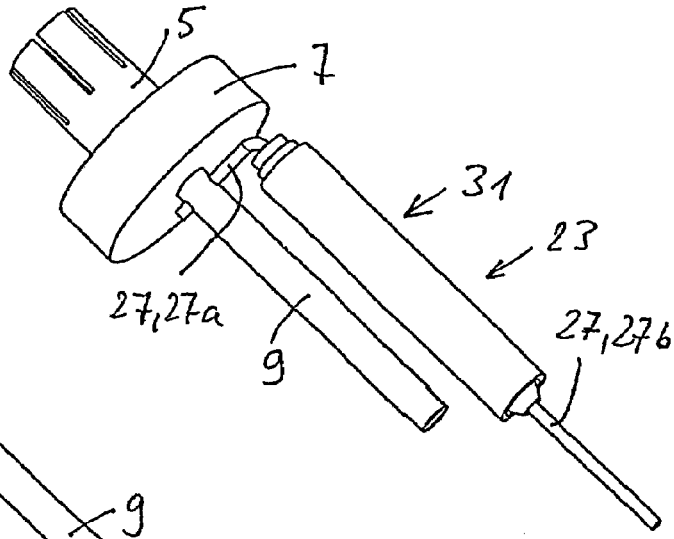
FIG. 3*b* is a view corresponding to FIG. 3*a*, wherein in the view of according to FIG. 3*b* the spacer, configured as a dielectric and holding the internal conductor relative to the external conductor, and also the LF internal conductor having the balun are still pre-assembled.
Figure 4A:
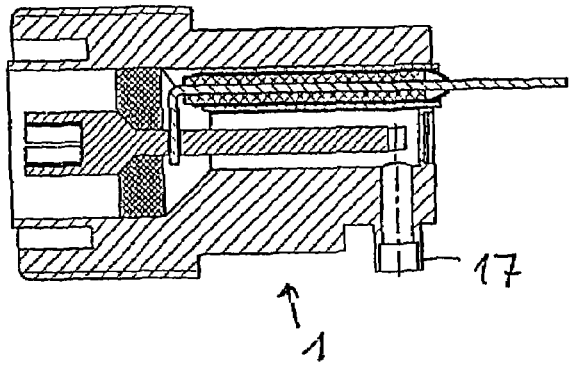
FIG. 4*a* is a size-reduced sectional view corresponding to FIG. 1 without the coaxial cable connected on the output side to the HF internal conductor.
Figure 4B:
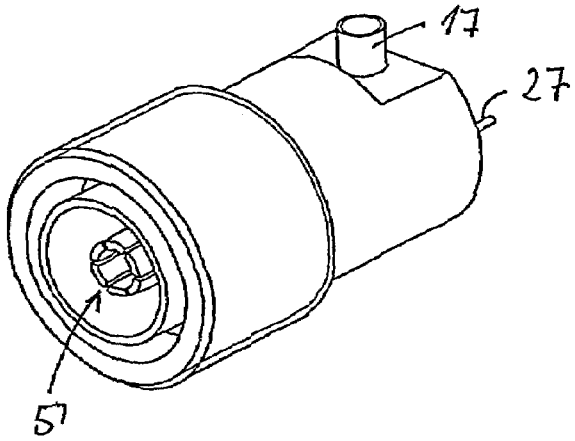
FIG. 4*b* is a perspective view of the exemplary illustrative non-limiting coaxial connector, looking onto the connector side.
Figure 4C:
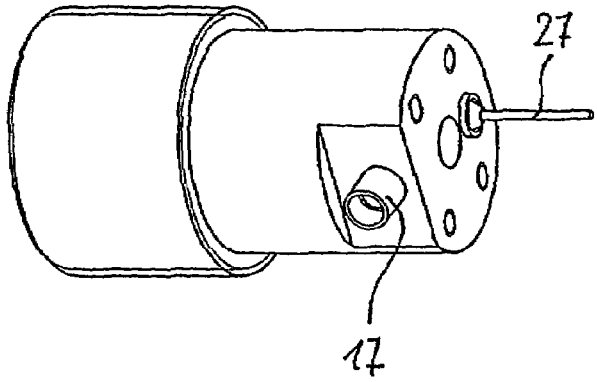
FIG. 4*c* is a further perspective view of the exemplary illustrative non-limiting plug-in connector shown in FIGS. 4*a* and 4*b*, looking onto the rearward branch side.

As the radial dimensions, including the external circumference of the decoupling module 23, are not larger in the illustrated non-limiting implementation than the disc-shaped dielectric 7, the arrangement can be such that the unit thus prepared and illustrated in perspective in FIG. 3*b*, including the decoupling branch 23, is inserted into the plug-in connector external conductor housing 3 from the coaxial connection side 8. Then, the aforementioned end of the radially supplied connection cable 13 at the radial connection portion 17 has merely to be introduced and the associated internal conductor portion and external conductor portion connected accordingly. The closure-side external conductor opening 3*a* can then be sealed by a closure cap 41. A corresponding coaxial plug-in connector 1 without the aforementioned radially supplied connection cable 17 is reproduced again in axial section in FIG. 4*a* and in a perspective view in FIGS. 4*b* and 4*c*.

Figure 5:
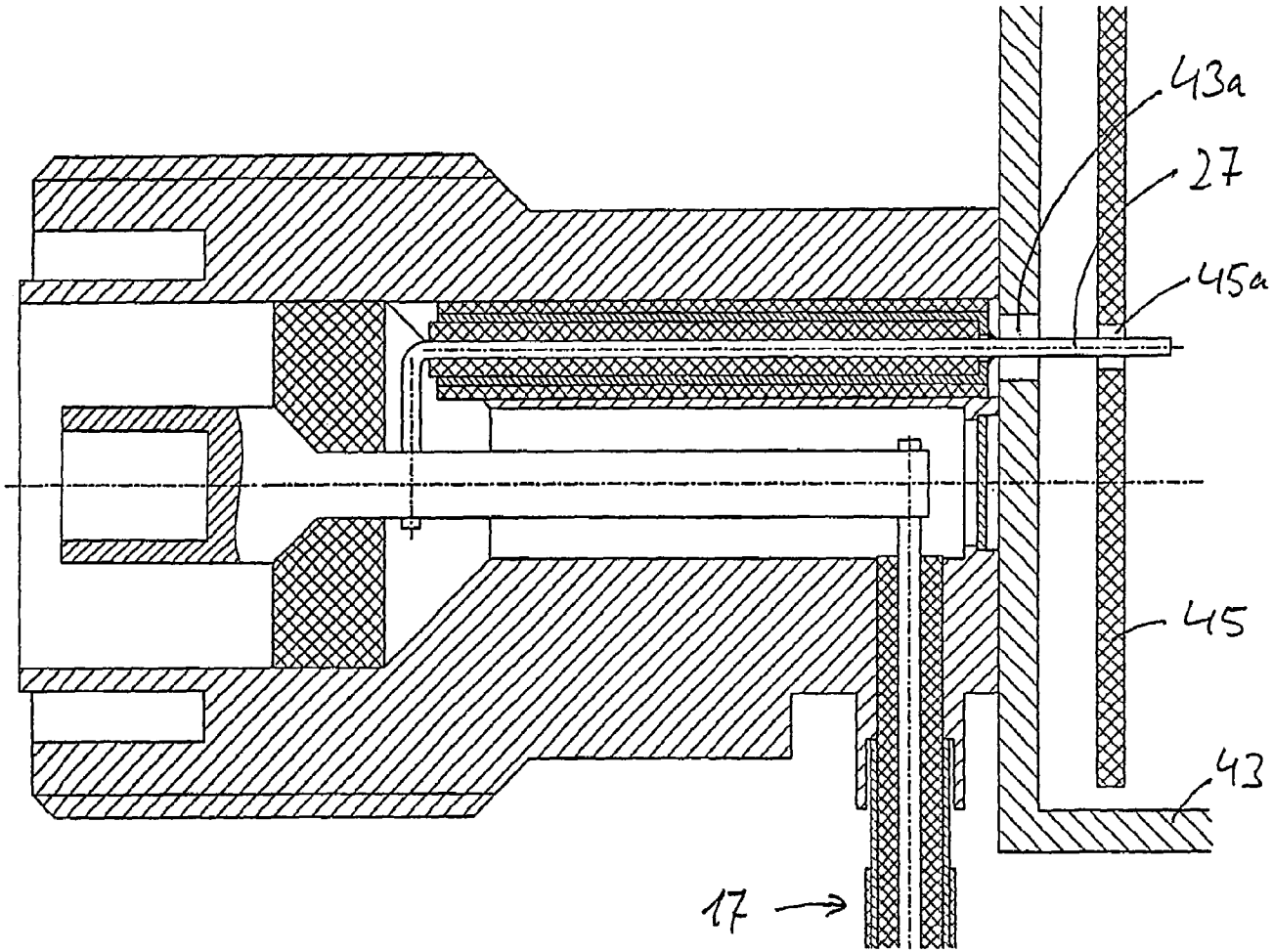
FIG. 5 is a view, reproduced in axial section compared to FIG. 1, of the exemplary illustrative non-limiting coaxial plug-in connector which is connected to the outer wall of an electrical appliance.

In FIG. 5, a coaxial plug-in connector, described in accordance with FIG. 1, is connected to an electronics housing 43, merely the decoupled LF signals and an optionally provided DC voltage signal (remote supply signal) being fed into the electronics housing via the LF internal conductor 27, namely via an opening or hole 43*a* provided in the electronics housing 43. The internal conductor can in this case project so as to reach a printed circuit board 45 accommodated in the electronics housing 43 and optionally to penetrate said printed circuit board in a hole 45*a*, where it can be soldered.

The HF signals are forwarded via the HF connection cable 13.

Figure 6:
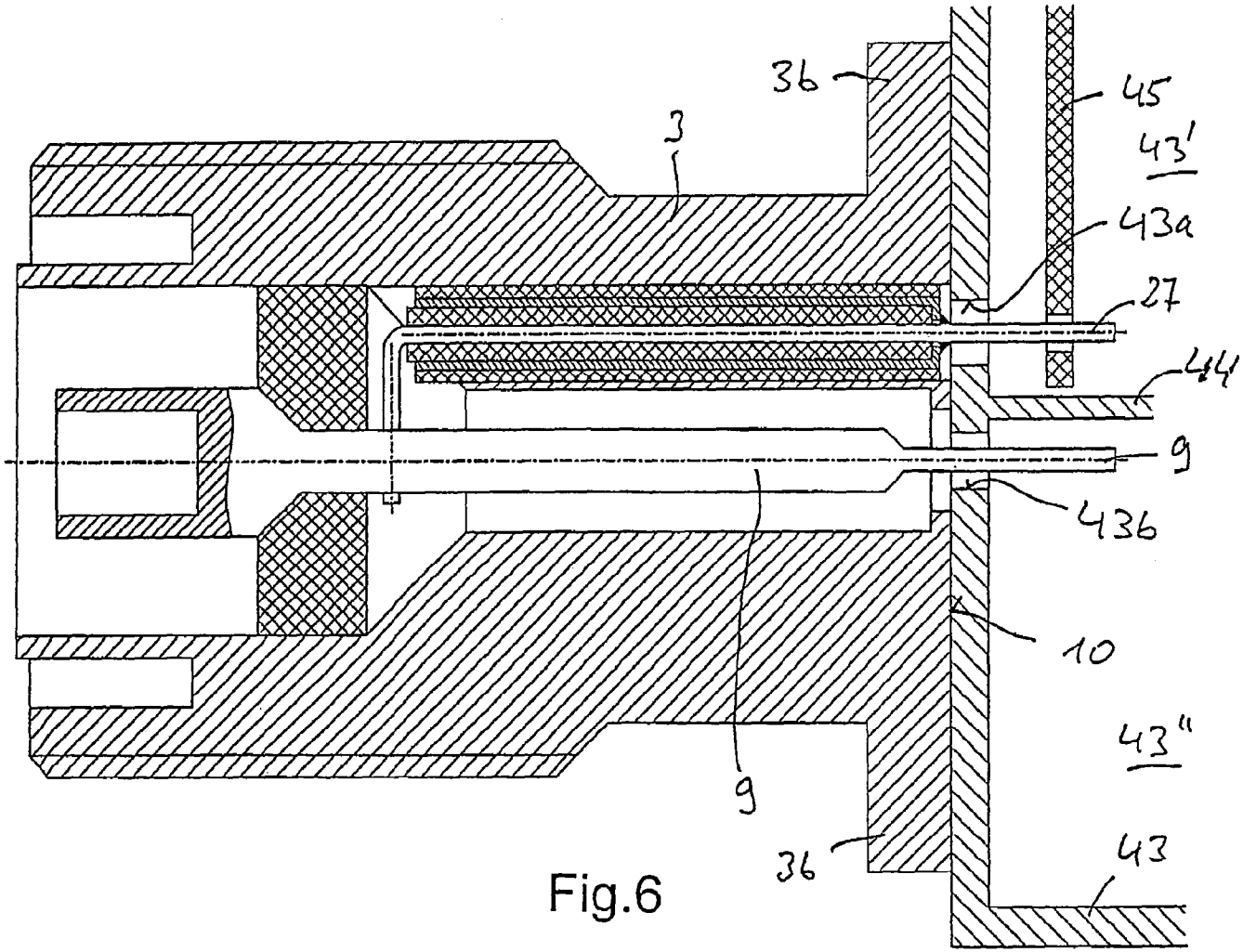
FIG. 6 is an axial sectional view, modified slightly from FIG. 5, of an exemplary coaxial plug-in connector which is suitable for connection to a housing wall and in which the HF internal conductor and LF internal conductor (9 and 27 respectively) are guided into the housing.

FIG. 6 shows a further illustrative non-limiting implementation.

In the implementation according to FIG. 6, the HF internal conductor 9 is also axially extended and protrudes beyond the connection end 10 of the plug-in connector external conductor or external conductor housing 3 and is in this case also guided into the electronics housing 43 via a further hole 43*b*, optionally into a second chamber 43" which is separated by a screened wall 44 from a first chamber 43' into which the LF internal conductor leads 27. If the housing 43 is manufactured by casting, the external conductor 3 can be formed in this variation in a highly cost-effective manner entirely, or at least partially, in the same production process.

Also different in this non-limiting implementation is the formation of the plug-in connector external conductor 3 at the connection end 10 thereof, which is provided in this case with a connection flange 3*b*.

Figure 6A:
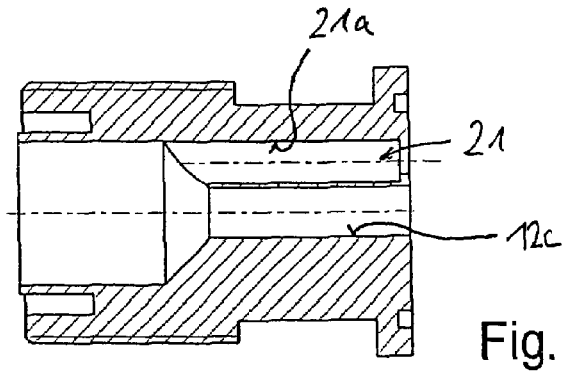
FIG. 6*a* is a size-reduced axial sectional view corresponding to FIG. 6, but without an inserted internal conductor.
Figure 6B:
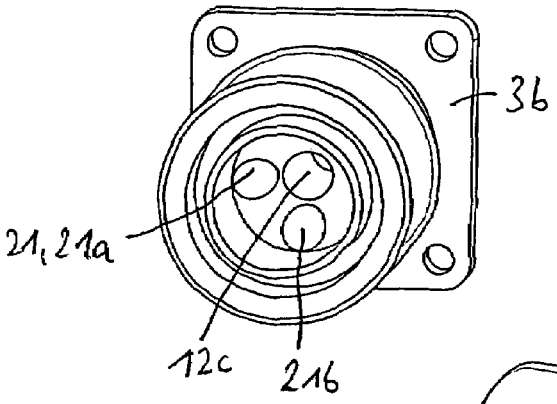
FIG. 6*b* is a perspective view of the external conductor shown in FIG. 6*a*, looking onto the connector side.
Figure 6C:
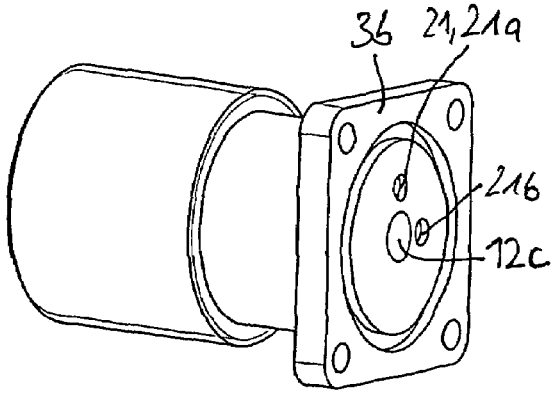
FIG. 6*c* is a corresponding perspective view of the external conductor shown in FIGS. 6*a* and 6*b*, looking onto the rearward connection side.

FIG. 6*a* to 6*c* reproduce the corresponding configuration of the external conductor, partially in axial section and partially in a perspective view with the associated connection flange 3*b* which, in the illustrated implementation, is of square configuration and has in its corners four respective holes via which screws can be screwed into the electronics housing (for fastening the coaxial plug-in connector).

Finally, FIGS. 6*b* and 6*c* also show that there is provided at this location, in addition to the central hole 12*c*, not only a further axial hole 21, axially offset for the decoupling branch, but also a second, likewise parallel hole 21*b*. This allows, for example, the accommodation of a further, second branch line which is constructed like the first branch line 23 and connected to the HF internal conductor 9. If a plurality of branch lines is provided, the associated baluns can also differ in length, to lock differing frequency ranges. Therefore, in principle, there can even be arranged more than one balun or even more than two baluns.

In contrast to the illustrated implementation, the baluns or the branch line 27 do not in all cases have to be arranged parallel to the HF internal conductor. Both lines can also diverge or at least diverge slightly. However, if possible, a diverging angle should be less than 10°, particularly preferably less than 9° or 5°.

Finally, the construction could also be inverted in such a way that the LF internal conductor 27 extends in the axial extension of the plug-in connector internal conductor 5 and the plug-in connector internal conductor 5 thus almost merges with the LF internal conductor 27. In this case, a first radial portion of the HF internal conductor 9 would then branch from the LF internal conductor 27 and then merge with a preferably parallel portion. This would lead almost to swapping-over of the two branches shown in FIG. 1.

Finally, however, a further possibility would be a Y-shaped branch in which there is provided in the immediate axial extension of the plug-in connector internal conductor 5 not a continuation but rather a double radial offset, so both the LF internal conductor and the HF internal conductor are preferably positioned parallel but radially laterally offset relative to the plug-in connector internal conductor 5.

Figure 7:
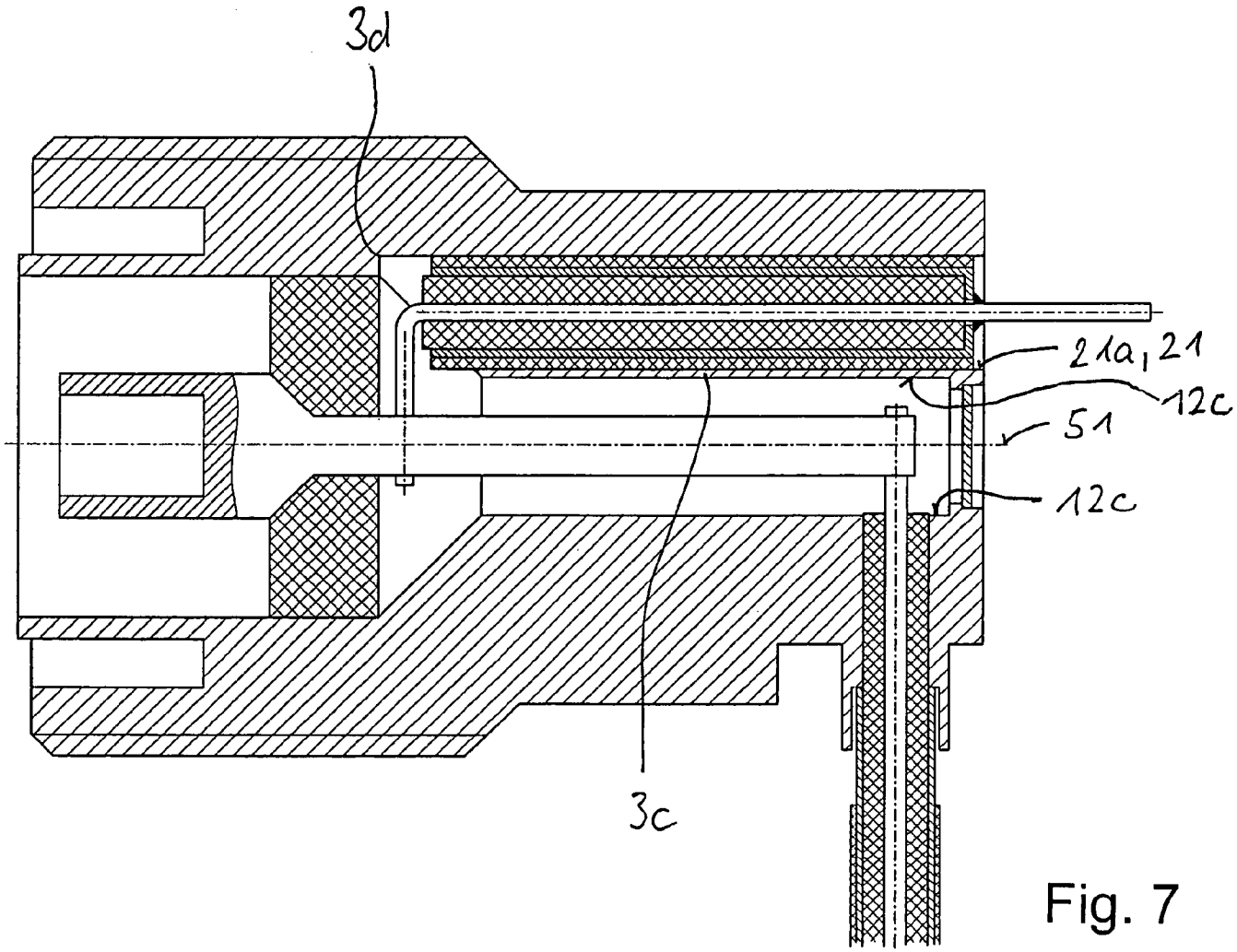
FIG. 7 shows an exemplary illustrative non-limiting coaxial plug-in connector having, compared to the view according to FIG. 1, a decoupling unit (23) having a larger external diameter.

Consideration will now be given to the FIG. 7 exemplary illustrative non-limiting implementation which differs from that according to FIG. 1 in that the decoupling means 23 has a larger external diameter and in that the balun ends further outward, viewed from the central axial line 51, i.e. radially further outward, so the hole 21*a* is not completely flush with the connection-side hole 12*a* but rather forms a stepped shoulder 3*d* in the central region. As a result, the entire arrangement cannot be inserted in fully preproduced form from the connection side but rather merely in the form of the plug-in connector internal conductor 5 having the associated HF internal conductor 9, the dielectric 7 as a holding means and also the correspondingly preassembled LF internal conductor 27. For the axially extending portion 27*a* of the LF internal conductor 27 is positioned so as to be able to be inserted through the hole 12*a* from the connection side. Then, the balun has to be inserted, along with the internal dielectric and the plastics material sheathing, into the hole 21*a* from the opposing side and soldered to the base 31*b* of the balun 31 at the end at the soldering point 34 of the LF internal conductors 27.

This construction can be necessary if the decoupling unit has to have a high impedance level, which is determined by the ratio of the internal diameter of the balun to the external diameter of the LF internal conductor, in order to achieve a high degree of uncoupling between the HF and LF signals.

It will be apparent from the exemplary implementations that the external conductor internal diameter and the internal conductor diameter reduce from the plug-in connector side toward the connection side, the impedance level preferably remaining constant. However, the impedance level does not have to remain constant. There are conceivable implementations in which the external conductor internal diameter and the internal conductor diameter remain constant. Furthermore, an exemplary illustrative non-limiting implementation can be carried out in such a way that, for example, both diameters, or at least one of the two, increase from the plug-in connector side toward the connection side.

As stated hereinbefore, the impedance level does not necessarily have to remain constant over the entire length as, for example, in a deliberate departure from a desired impedance level value, other impedance level values can be important, i.e. if, for example, compensation is to be provided for impedance value deviations originating from a standardized range or produced by soldering points.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. Coaxial HF plug-in connector having a connection side, having an HF internal conductor and having a hole in the material of an external conductor, in which hole an electric component is arranged, the component in the hole is a decoupling branch, the decoupling branch comprises an LF internal conductor, an internal dielectric, a balun having a balun base and an external dielectric, the LF internal conductor is connected to the balun base, the balun base being located remote from the coaxial connection side, and in that, the LF internal conductor at the open end of the balun is electrically connected to the HF internal conductor of the plug-in connector.

2. Coaxial HF plug-in connector according to claim 1, wherein the length of the balun corresponds to $\lambda/4$ or $(1/\sqrt{\in r})*\lambda/4$, $\lambda$ being a wavelength, preferably the central wavelength of the high frequency to be transmitted in the HF branch.

3. Coaxial HF plug-in connector according to claim 1, wherein the HF internal conductor and/or the LF internal conductor is/are integrally connected to the plug-in connector internal conductor.

4. Coaxial HF plug-in connector according to claim 1, wherein the HF internal conductor and/or the LF internal conductor is/are connected to the plug-in connector internal conductor via a plug-in connection and/or to each other via a soldered connection.

5. Coaxial HF plug-in connector according to claim 1, wherein the HF internal conductor is located in the axial extension of the plug-in connector internal conductor and the LF internal conductor is offset relative thereto.

6. Coaxial HF plug-in connector according to claim 1, wherein the LF internal conductor is located in the axial extension of the plug-in connector internal conductor and the HF internal conductor is offset relative thereto.

7. Coaxial HF plug-in connector according to claim 1, wherein the LF internal conductor comprises an axial portion and a radial portion, the LF internal conductor being electrically connected to the plug-in connector internal conductor or HF internal conductor via its radial portion.

8. Coaxial HF plug-in connector according to claim 1, wherein the HF internal conductor and the LF internal conductor extend parallel to each other or have a diverging angle which is less than 10°.

9. Coaxial HF plug-in connector according to claim 1, wherein the balun is filled with a dielectric, preferably made of plastics material.

10. Coaxial HF plug-in connector according to claim 1, wherein the balun comprising an external dielectric is arranged so as to be electrogalvanically isolated from the plug-in connector external conductor, the dielectric preferably being made of plastics material.

11. Coaxial HF plug-in connector according to claim 1, wherein a plurality of holes is provided for a plurality of decoupling branches.

12. Coaxial HF plug-in connector according to claim 1, wherein the balun base has a hole which is penetrated by the LF internal conductor, the LF internal conductor being soldered to the balun base preferably on the outside thereof.

13. Coaxial HF plug-in connector according to claim 1, wherein the axial holes and/or the axial spaces inside the plug-in connector external conductor are formed in such a way and the maximum radial extension between the HF internal conductor and the outside of the balun or of the dielectric surrounding the balun is of such a size that a preproduced constructional unit consisting of the plug-in connector internal conductor, HF internal conductor, LF internal conductor and also the associated balun and preferably of a dielectric attached to the plug-in connector internal conductor can be inserted or introduced into the plug-in external conductor from the coaxial connection side.

14. Coaxial HF plug-in connector according to claim 1, wherein the axial holes and/or the axial spaces inside the plug-in connector external conductor are formed in such a way and the maximum radial extension between the HF internal conductor and the outside of the balun or of the dielectric surrounding the balun is of such a size that a preproduced constructional unit consisting of the plug-in connector internal conductor, HF internal conductor, LF internal conductor and preferably of a dielectric attached to the plug-in connector internal conductor can be inserted or introduced into the plug-in connector external conductor from the connection side and the corresponding balun can be inserted into the hole provided for this purpose from the opposing side and is electrically connectable to the LF internal conductor.

15. Coaxial HF plug-in connector according to claim 1, wherein the HF internal conductor ends in the plug-in connector external conductor and there is provided in the plug-in connector external conductor a connection portion via which a coaxial connection cable, the internal conductor of which can be contacted with the HF internal conductor, can be connected.

16. Coaxial HF plug-in connector according to claim 1, wherein the HF internal conductor is axially guided out at the end-face external conductor end via a hole provided therein.

17. Coaxial HF plug-in connector according to claim 1, wherein the LF internal conductor is guided out of the plug-in connector external conductor at the end-face external conductor end.

18. Coaxial HF plug-in connector according to claim 1, wherein a plurality of decoupling lines is provided with a plurality of baluns), preferably in parallel and in particular in axial orientation.

19. Coaxial HF plug-in connector according to claim 18, wherein the baluns are of differing electrical length, if at least two decoupling branches are provided with at least one respective balun, are different in length and thus have a locking effect with respect to differing frequencies or frequency ranges.

20. Coaxial HF plug-in connector according to claim 1, wherein the external conductor internal diameter and the internal conductor diameter decrease from the plug-in connector side toward the connection side, the impedance level preferably remaining constant.

21. Coaxial HF plug-in connector according to claim 1, wherein the external conductor internal diameter and the internal conductor diameter have a uniform diameter from the plug-in connector side toward the connection side.

22. Coaxial HF plug-in connector according to claim 1, wherein the external conductor internal diameter and the internal conductor diameter increase from the plug-in connector side to the connection side, the impedance level preferably varying.

* * * * *